United States Patent [19]

Hatch

[11] Patent Number: 4,673,020

[45] Date of Patent: Jun. 16, 1987

[54] FOUNDRY MOLDING MACHINE AND METHOD

[75] Inventor: Edmond K. Hatch, Brecksville, Ohio

[73] Assignee: Equipment Merchants International Inc., Cleveland, Ohio

[21] Appl. No.: 717,388

[22] Filed: Mar. 29, 1985

Related U.S. Application Data

[63] Continuation-in-part of Ser. No. 544,105, Oct. 21, 1983, abandoned, and Ser. No. 544,104, Oct. 21, 1983, abandoned.

[51] Int. Cl.[4] ..... B22C 15/02

[52] U.S. Cl. ..... 164/40; 164/187

[58] Field of Search ..... 164/40, 187

[56] References Cited

U.S. PATENT DOCUMENTS

| | | | |
|---|---|---|---|
| 3,205,542 | 9/1965 | Miller et al. | 164/187 |
| 3,589,432 | 6/1971 | Miller et al. | 164/40 X |
| 3,628,592 | 12/1971 | Taccone | 164/40 X |
| 3,664,406 | 5/1972 | Mawson et al. | 164/40 X |

FOREIGN PATENT DOCUMENTS

| | | | |
|---|---|---|---|
| 46-31664 | 9/1971 | Japan | 164/40 |
| 46-42709 | 12/1971 | Japan | 164/40 |
| 747608 | 7/1980 | U.S.S.R. | 164/187 |

*Primary Examiner*—Nicholas P. Godici
*Assistant Examiner*—J. Reed Batten, Jr.
*Attorney, Agent, or Firm*—Renner, Otto, Boisselle & Lyon

[57] ABSTRACT

A foundry molding machine is provided with a pattern plate surrounded by and movable in a well form. In a preferred form springs bias the well form upwardly around the pattern plate to form a well. The pattern plate and well form are mounted on a squeeze table and cooperate with the underside of a conventional flask which in turn engages an upset to form a mold chamber for receiving molding sand. In such preferred form the sand is blown under very low pressure into the chamber through a slotted squeeze head. As the squeeze table moves upwardly, sand is initially squeezed from the top against the squeeze head while the flask, upset, well form and pattern plate move upwardly as a unit. When a selected level of the flask is reached, preferably when the top is flush with the squeeze head, upward movement of the upset is stopped while the table continues upwardly. The pattern plate then telescopes upwardly within the well form while the flask and well form are held fixed. This compresses the springs supporting the well form. The squeeze continues with the sand being compressed both from the squeeze head and from the pattern plate concurrently until the pattern plate is just even with or slightly below the bottom of the flask. At such time, the table moves down for draw as the springs extend and to permit the mold to clear the machine. Other forms of the present invention provide embodiments utilizing a dump-fill of the flask in combination with an equalizing cylinder squeeze head. In yet another embodiment, the well form may be mounted by a piston-cylinder assembly for movement independently of the pattern plate thus enabling the depth of the well to be adjusted between cycles.

52 Claims, 16 Drawing Figures

10
10
130
131
107
115
113
111
87
106
117
122
120
104
108
109
110
102
94
116
105
99
101
135
134
138
137
132
86
92
85

FIG. 13
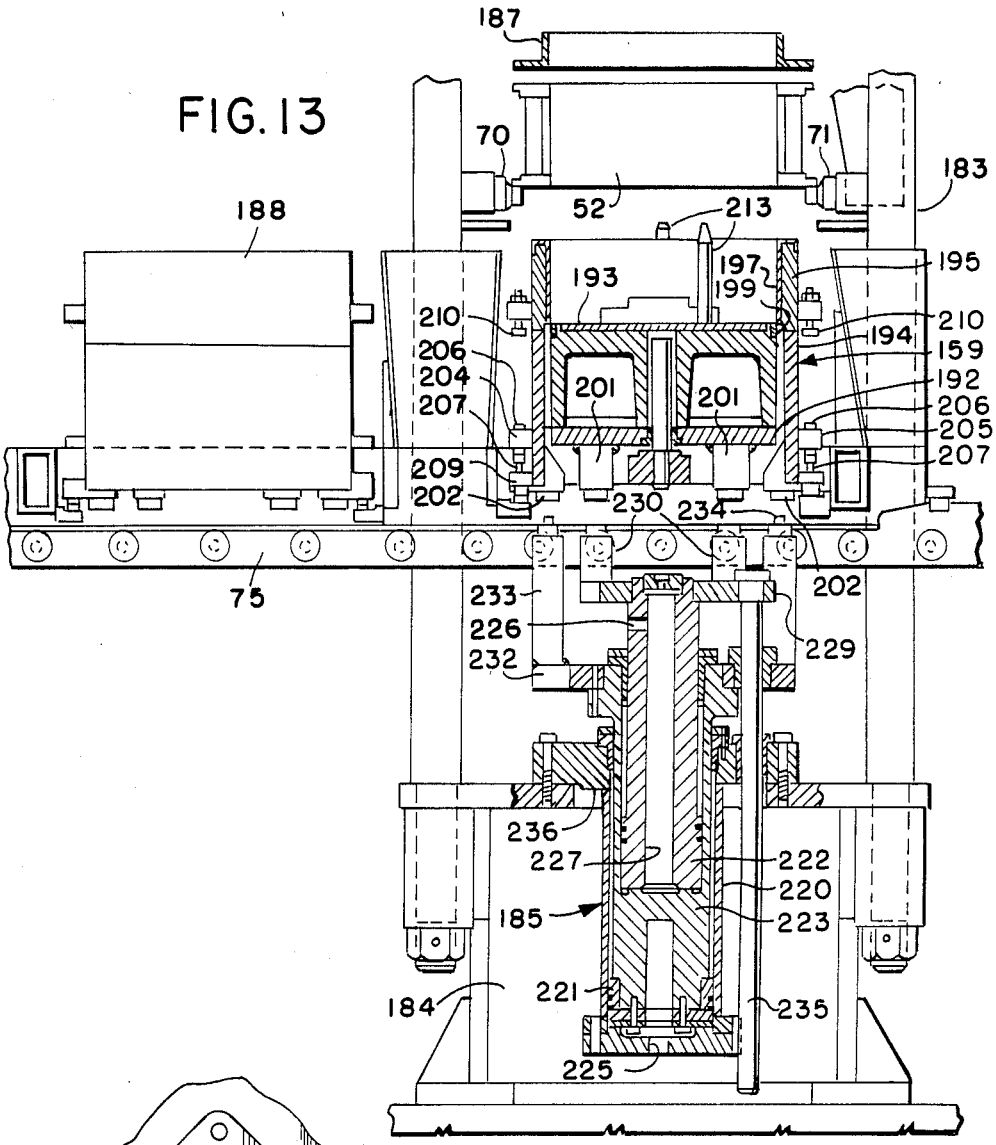
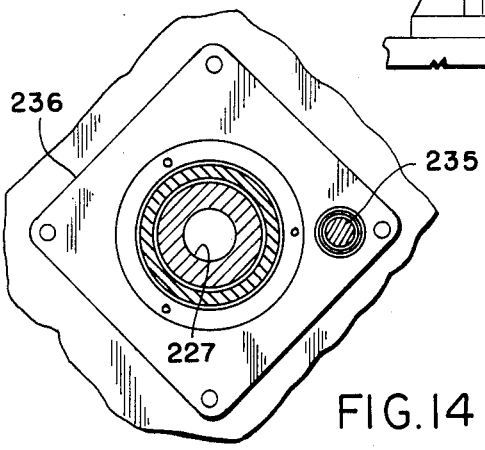
FIG. 14
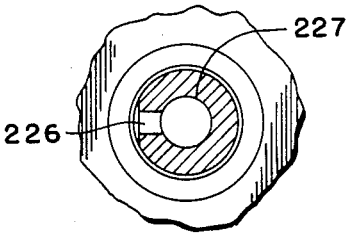
FIG. 15

FOUNDRY MOLDING MACHINE AND METHOD

RELATED APPLICATIONS

This application is a continuation-in-part of applicant's colending applications entitled "Foundry Molding Machine and Method", Ser. No. 544,105, filed Oct. 21, 1983, and application Ser. No. 544,104, also entitled "Foundry Molding Machine and Method", and also filed Oct. 21, 1983, both now abandoned.

BACKGROUND OF THE INVENTION

The present invention relates generally as indicated to a foundry molding machine and method and more particularly to machines providing a parting plane squeeze to achieve uniform high mold hardness over essentially the entire pattern plate face of the mold, while being able to produce such molds at a high production rate with minimal energy requirements.

Conventional foundry mold making machines either of the blow-fill or dump-fill type normally produce a foundry mold having the requisite mold hardness in the center of the flask area, but not necessarily over the entire area of the flask at the pattern. This then limits the configuration of the pattern or the number of patterns which may be utilized in a given pattern plate thus greatly restricting the productivity of the molding system. For example, in some molding machines, a pattern configuration cannot be placed closer than three to five inches from the edge of the flask because of mold hardness problems.

Efforts have been made to alleviate these problems with the use of complex squeeze heads or heads which employ movable portions which apply greater pressure and more squeeze to areas of the mold having greater depth. Also, jolt machines have widely been used to attempt to alleviate these problems. Jolt machines, while in most cases effective, are expensive to build, expensive to maintain, and create a noise environment which is not desirable. Moreover, providing a jolt normally lengthens the cycle of the machine particularly if incorporated with a subsequent squeeze.

Even in blow-squeeze molding machines, the blow operation is normally utilized to pre-compact the sand and this must generally be accomplished under fairly high air pressures such as 50 to 60 psi. Again, such machines normally provide the high mold hardness required only in the center of the mold but not completely to the edge of the flask thus greatly restricting the productivity which may be achieved with a given mold. Moreover, blow-squeeze molding machines operating at such pressures require substantial amounts of energy and are more costly. For example, seals and their maintenance problems may be avoided at much lower pressures. Further, such lower pressures require smaller valves and of course the energy required to operate such valves. Thus not only smaller but fewer valves need be employed. Also, the lower air pressures in a blow operation do not create nearly the sand, dust or dirt problems normally associated with high pressure blow-squeeze machines.

For these reasons it is desirable to provide a foundry molding machine of the blow-squeeze type which can operate at quite low air pressures. It is also desirable to provide such machine which can, with a short cycle time, produce a foundry mold which has high uniform hardness across the entire pattern plate face with an extremely short and energy efficient machine cycle.

SUMMARY OF THE INVENTION

The present invention in a preferred form comprises a very low pressure blow-squeeze machine which includes a vertical frame in which a flask is positioned. The lower portion of the frame is provided with a vertically movable squeeze table operated by a vertically extending hydraulic piston-cylinder assembly. The top of the frame is provided with a blow reservoir which includes at its lower end a slotted blow-squeeze head. The blow-squeeze head is surrounded by a vertically movable upset mounted on hydraulic cylinders.

A pattern plate stool assembly is positioned above the squeeze table and includes a pattern plate and an upwardly extending well form within which the pattern plate may be telescoped.

Both the upset and the well form are adapted to contact the top and bottom, respectively, of a flask which may be positioned in the machine on suitable conveyors.

The pattern plate stool assembly, which also may be mounted on a conveyor assembly for quick changing purposes, comprises the pattern plate surrounded by and movable in a well form.

In a preferred form springs bias the well form upwardly around the pattern plate to form a well. The pattern plate and well form cooperate with the underside of a conventional flask which in turn engages an upset to form a mold chamber for receiving the molding sand. In such preferred form the sand is blown under very low pressure into the chamber through a slotted squeeze head. As the squeeze table moves upwardly, sand is initially squeezed from the top against the squeeze head while the flask, upset, well form and pattern plate move upwardly as a unit. When a selected level of the flask is reached, preferably when the top of the flask is flush with the squeeze head, upward movement of the upset is stopped, while the table continues upwardly. The pattern plate then telescopes upwardly within the well form while the flask and well form are held fixed. This compresses the springs supporting the well form. The squeeze continues until the pattern plate is just even with or slightly below the bottom of the flask, at which time the table reverses with the springs initially drawing the pattern from the now formed mold.

In such preferred embodiment, the blow-fill-squeeze system utilizes only minimum air pressure, resulting in quiet operation with significant energy savings. The slotted all-purpose blow head effectively directs sand to all areas of the flask for a quick and even fill at such low pressure. During fill, the pattern is recessed below the bottom of the flask, and is then squeezed upwardly to the parting line during the molding cycle. Concurrently during such upward parting plane squeeze, pressure is being applied to the top of the mold. This sequenced squeeze (initially top and then top and bottom) generates a highly dense and uniform mold, allowing greater utilization of the flask area and production of higher quality and more dimensionally accurate castings. Also, in the preferred embodiment there may be no strike-off after fill, and sand consumption per mold is reduced and expensive sand return equipment is not required.

In other embodiments of the present invention, conventional sand dump through aerators may be employed with the utilization of special squeeze heads such as those employing equalizing cylinders. Also, in some embodiments the well form may be mounted on a piston-cylinder assembly construction independently of the pattern plate so that the depth of the well may be adjusted from cycle to cycle or even during the cycle.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In said annexed drawings:

FIG. 13 is a fragmentary vertical section through the base of another form of the present invention utilizing a piston-cylinder assembly for moving the well form independently or concurrently with the pattern plate;

FIG. 14 is a fragmentary horizontal section taken substantially on the line 14—14 of FIG. 13;

FIG. 15 is a fragmentary horizontal section taken substantially on the line 15—15 of FIG. 13.

DESCRIPTION OF THE PREFERRED EMBODIMENTS

Figure 1:
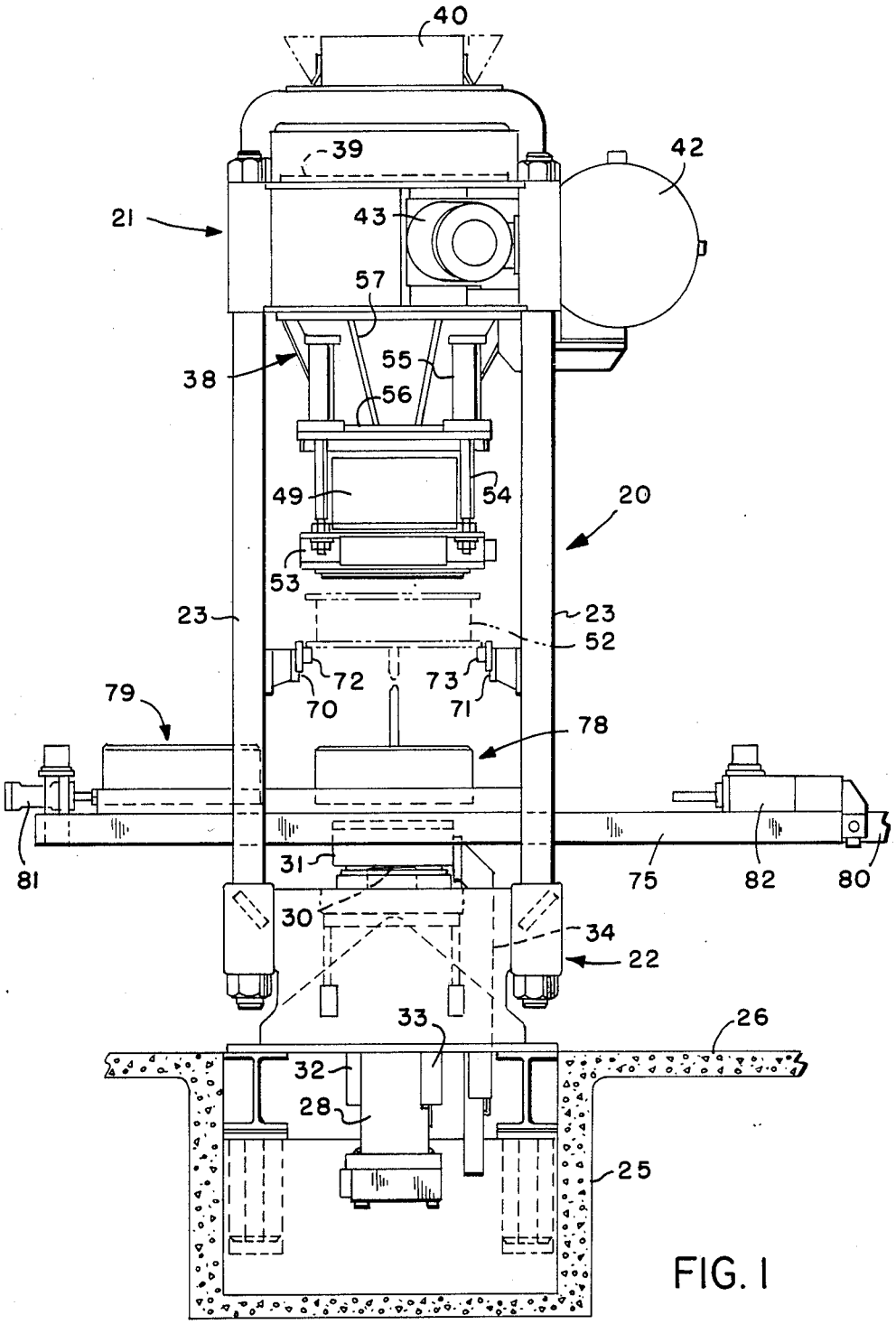
FIG. 1 is an elevation of a preferred embodiment of the present invention.

Referring first to FIG. 1 it will be seen that the machine shown generally at 20 comprises an upright frame which includes a head frame 21 and a base frame 22 interconnected by four corner columns seen generally at 23.

As indicated, the base frame is mounted in a suitable foundation which includes a pit 25 extending below floor level 26. The base frame supports vertically extending hydraulic piston-cylinder assembly 28. The top of the rod 30 of such piston-cylinder assembly supports squeeze table 31. The table includes downwardly extending guide rods 32 and 33 which simply prevent rotation of the table or the piston rod about the extension axis. Also mounted on the table is a progammable linear transducer 34 which can "read" the position of the table throughout its stroke. Such transducer serves essentially the same purpose as adjustable limit switches.

The head frame 21 supports the upper generally cylindrical end 37 (see FIG. 3) of blow reservoir 38. The top of the blow reservoir is opened and closed by a shuttling seal plate 39 which moves normal to the plane of FIG. 1. When the plate is opened, the sand reservoir is charged with sand through hopper 40. Also mounted on the head frame is an air reservoir 42 and suitable blow and exhaust valves indicated generally at 43.

Figure 2:
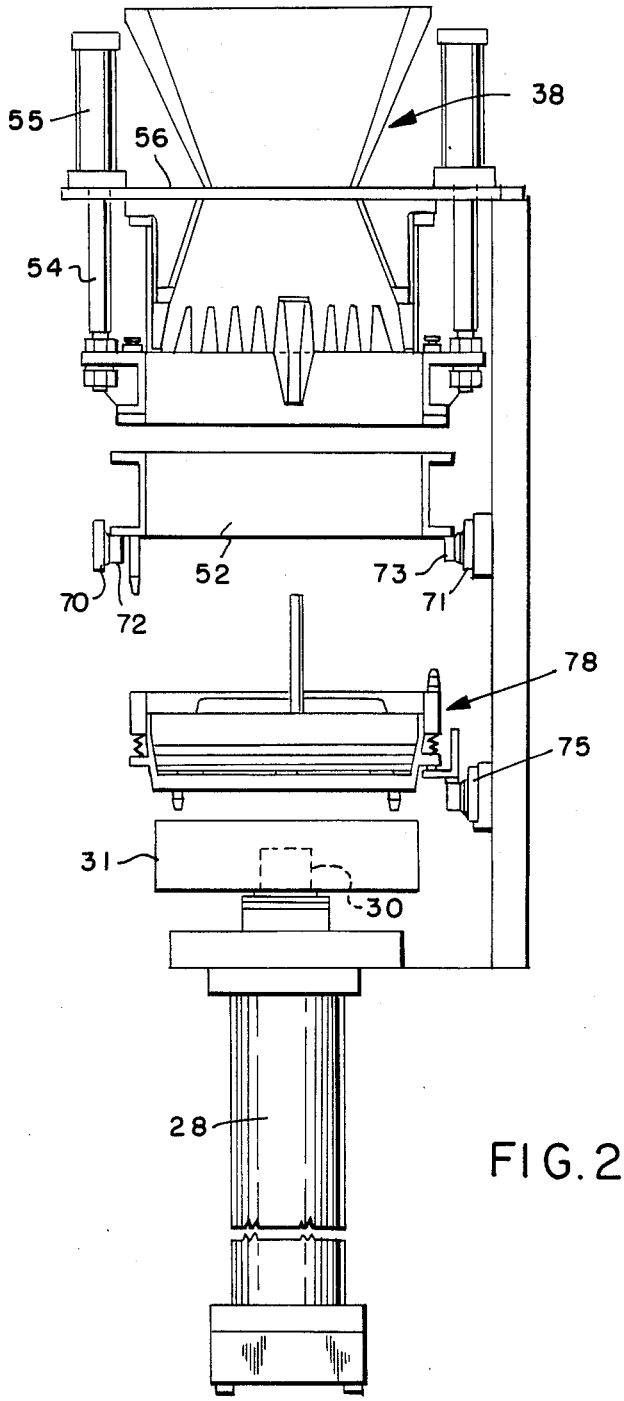
FIG. 2 is a schematic elevation of the machine of FIG. 1 illustrating the position of the parts with the squeeze cylinder and table fully down.
Figure 3:
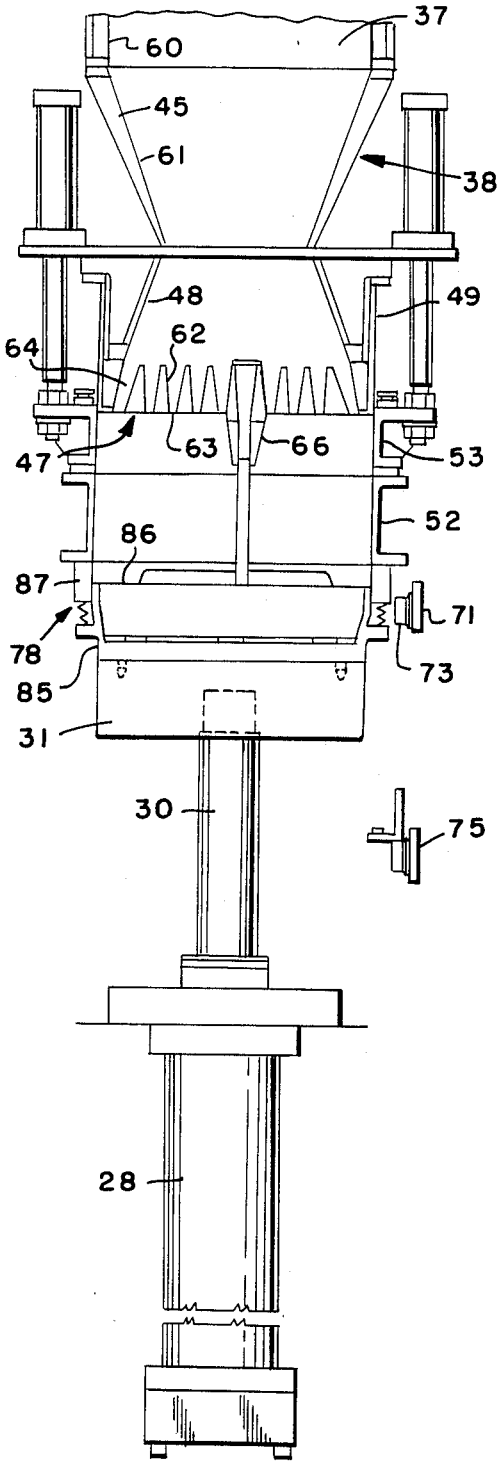
FIG. 3 is a view similar to FIG. 2 illustrating the table stopped at the blow position.
Figure 4:
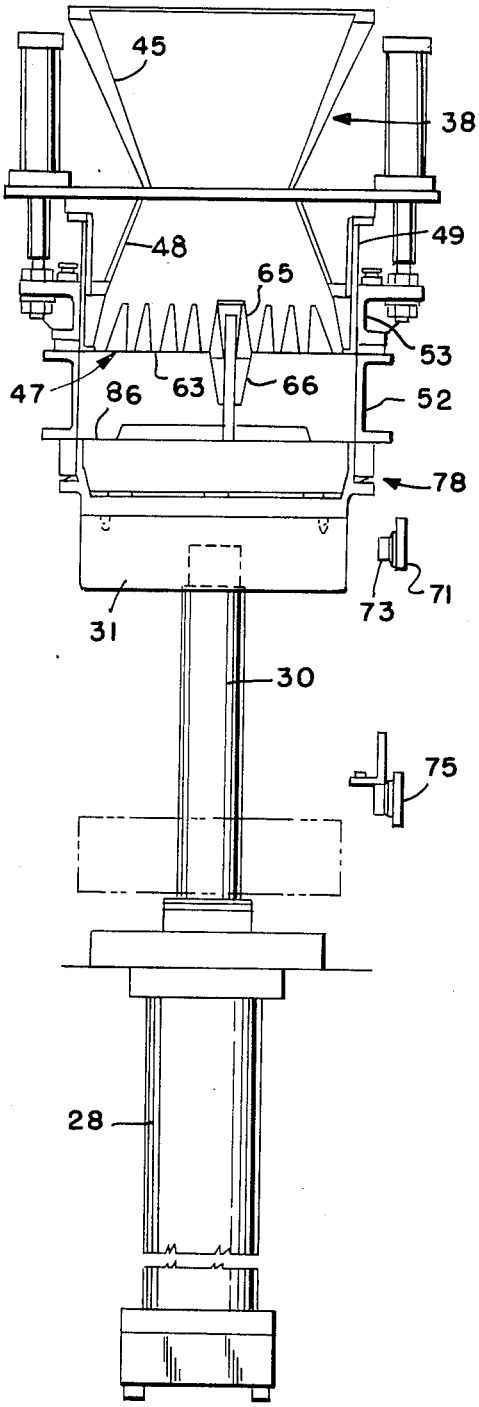
FIG. 4 is a view similar to FIGS. 2 and 3 illustrating the table at maximum height with the squeeze completed.
Figure 7:
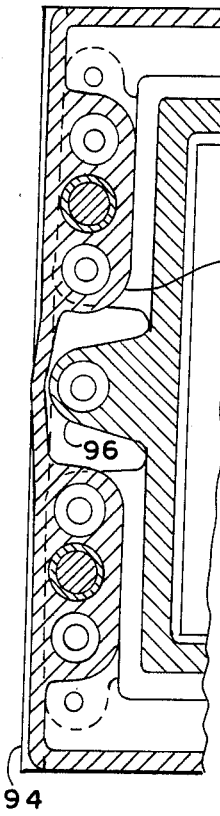
FIG. 7 is a fragmentary horizontal section taken substantially on the line 7—7 of FIG. 6.
Figure 5:
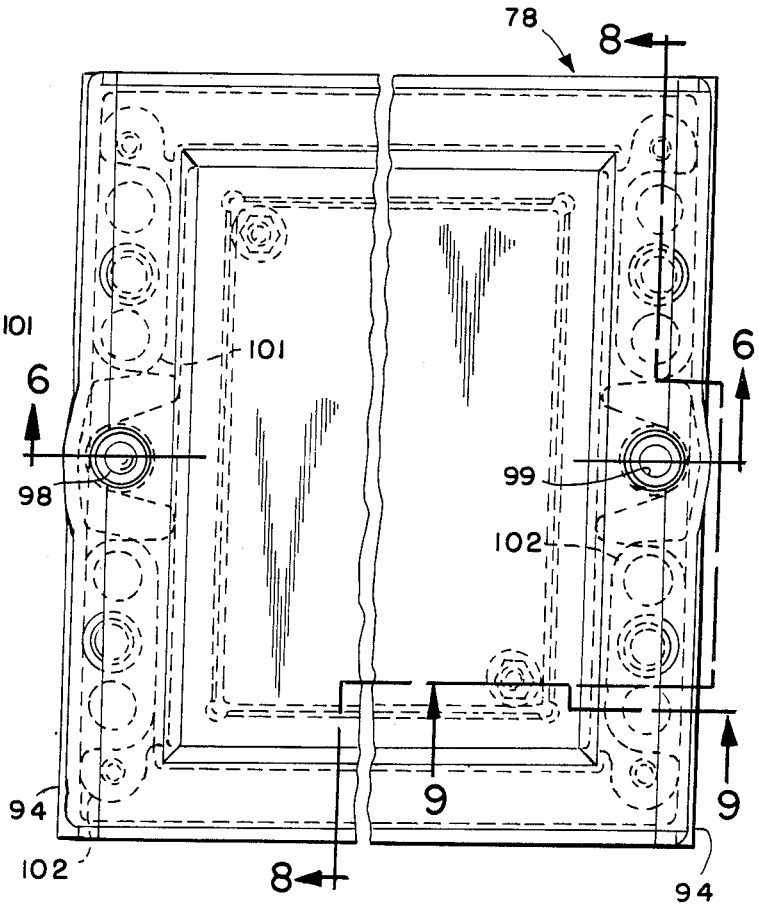
FIG. 5 is an enlarged top plan view of the pattern stool assembly which is broken away in the middle.
Figure 6:
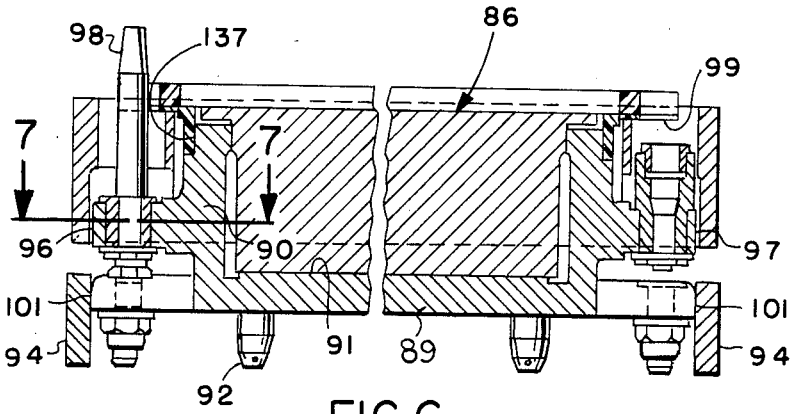
FIG. 6 is a vertical section of such assembly taken substantially on the line 6—6 of FIG. 5.
Figures 8, 9, 10:
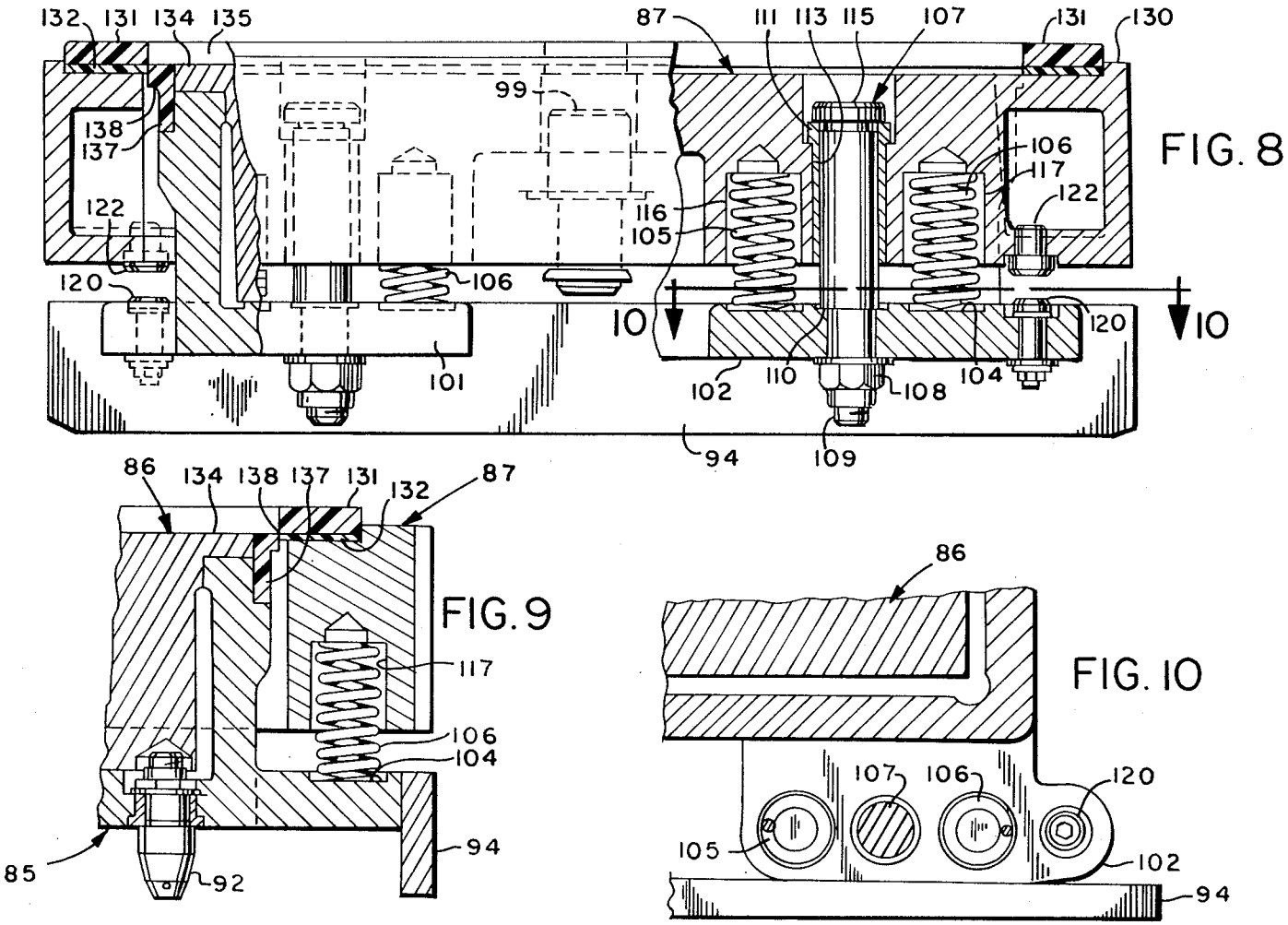
FIG. 8 is an enlarged broken section taken substantially on the line 8—8 of FIG. 5.
FIG. 9 is a fragmentary section taken substantially on the line 9—9 of FIG. 5.
FIG. 10 is a horizontal section taken substantially on the line 10—10 of FIG. 8.

Referring now additionally to FIGS. 2–4 it will be seen that the reservoir 38, in addition to the upper cylindrical section 37 includes an intermediate conical section which tapers inwardly, and a lower somewhat conical section 46 which tapers outwardly to terminate in slotted rectangular blow-squeeze head 47, generally corresponding to the flask area. The exterior of the lower section 48 is provided with an exterior vertically extending wall 49 which constitutes in essence a continuation of the rectangular interior of the flask 52 and vertically movable upset frame 53. The sliding portion of the upset and wall may normally be provided with a sliding seal, but which, because of the low pressure blow, may be omitted.

The upset frame is mounted on the rods 54 of piston-cylinder assemblies 55, there being four such piston-cylinder assemblies, one at each corner. The piston-cylinder assemblies are mounted on plate 56 which surrounds the reservoir at the neck between the portions 45 and 48. As noted the portion 45 of the reservoir may be provided with gusset plates seen at 57 to rigidify the structure. The piston-cylinder assemblies 55 are preferably operated by an air-over-oil hydraulic system.

As indicated more clearly in FIGS. 2–4, the upper cylindrical portion of the reservoir as well as the intermediate conical portion are both provided with slotted screens shown generally at 60 and 61. During the blow operation, after the reservoir has been charged with sand and the slide plate 39 closed and sealed, air is admitted to the reservoir from behind such screens at relatively low pressure, such as from about 10 to about 30 psi, fluidizing the sand in the reservoir and forcing it through the slots 62 in the squeeze head 47. The configuration of the slots 62 is such that they are quite deep which provides a rigid squeeze head 47 and it is noted that such slots taper to more narrow openings 63 at the bottom. Also, the side slots 64 taper outwardly to ensure that the entire flask area is filled with the fluidized sand which occurs during the blow operation. Also it will be seen that the slotted blow head 47 may be provided with a sprue pin receiver seen generally at 65 and a projection 66 which surrounds the sprue pin and adapted to form a pouring basin. Such sprue pin receiver and pouring basin former may be omitted if the sprue hole and pouring basin are formed otherwise.

The columns of the frames support horizontal rails 70 and 71 on which are mounted conveyor rollers 72 and 73 to enable successive flasks 52 to roll into the machine and completed molds to roll out.

Below the flask roll-in and roll-out height there is provided a relatively short conveyor 75 which may be employed relatively quickly to change pattern stool assemblies 78. For example, if both cope and drag molds are being formed alternately, a similar pattern stool assembly 79 would be provided. Such pattern stool assemblies would then simply shuttle in and out every cycle of the machine. A piston-cylinder assembly 80 may be provided for such purpose with shock absorbers 81 and 82 being provided at each end of such movement. The pattern shuttle also facilitates the quick change of patterns. It is noted that the pattern conveyor rail 75 seen in FIGS. 2–4 is 90° out of position simply for illustration purposes.

Referring now additionally to FIGS. 5–10, it will be seen that the pattern stool assembly 78 comprises three main parts, namely: base 85; pattern 86; and well form 87. The base 85 includes a bottom plate 89 and an upstanding wall 90 within which the pattern 86 is received. The pattern rests on the top 91 of the bottom wall, either directly or on finished shims or support surfaces. The bottom wall 89 includes guide pins 92 which may engage suitable pin bushings in the top of squeeze table 31. Also mounted on the underside of the plate 89 are suitable rails 94 which may be utilized to support the pattern stool assembly on conveyor rollers. The rails may be positioned at any desired location to facilitate such shuttle.

Opposite walls of the base are provided with projections seen at 96 and 97 on which may be mounted either guide pins 98 or guide pin bushings 99. The guide pin projects upwardly and will cooperate with a guide pin bushing on the underside of the lower flange of the flask. Conversely, guide pins may be mounted on the flask to cooperate with guide pin bushings such as 99. It will be appreciated that both may be guide pins or both may be guide pin bushings.

Also projecting laterally from the wall of the base are two shelves 101 and 102 on each side of the pattern stool assembly. As seen more clearly perhaps in FIGS. 8, 9 and 10, each shelf includes seats 104 for compression springs 105 and 106 which are positioned on either side of a guide pin 107 which is secured to the shelf by nut and washer assembly 108 threaded on the lower end 109 of such pin assembly, such pin assembly being provided with a shoulder seated at 110 on the top of the shelf. The pin assembly fits within a shouldered guide bushing 111 mounted in shouldered hole 113 in the well form 87. The top of the pin 107 is provided with a cap 115 adapted to engage the top of the shouldered bushing. The springs 105 and 106 are seated in recesses 116 and 117 in the underside of the well form.

At the outermost end of each shelf there is provided a stop button 120 which is on the head of a stud secured to the shelf in the manner illustrated. The stop button 120 cooperates with stop button 122 mounted on the underside of the well form. It can now be seen that the movement of the well form downwardly against the compression of the springs is limited by the position of the stop buttons 120 and 122 while the separation of the well form from the base or pattern is limited by the stop caps 115. The spacing for such extent of movement can readily be adjusted by replacing or adjusting such stop surfaces. As illustrated, there are two such stop surfaces or button sets 120 and 122 at each end of the pattern stool assembly, or four altogether, and that there are four compression springs at each end of the pattern stool assembly, or eight altogether. There are also two guide and stop pins 107 at each end of the guide and stool assembly or four altogether.

As illustrated, the well form 87 is in the form of a perimetral frame which is solid in the areas of the springs and headed guide pins but which is essentially channel shaped elsewhere. The perimetral frame includes a slightly upstanding peripheral edge 130 in which are mounted projecting wear strips 131 and 132 which extend above the top of the well form, but more importantly above the top surface 134 of the pattern plate. The wear strips extend completely around the pattern and form a well 135 within which the pattern plate is recessed. The periphery of the pattern plate which rests on the peripheral wall of the base includes an edge strip 137 which includes a horizontally outwardly extending projection 138 which wipes closely against the interior of the wear strips. The wear strips and seals may be made of suitable plastic material such as TEFLON.

It will be appreciated that the dimensions of the wear strips may readily be altered along with the positions of the stops 115, 120 and 122 to alter the depth of the well. For example, the depth of the well may be varied from approximately $\frac{3}{4}$ inch to in excess of 5 inches depending upon the flask size and the particular pattern employed. Also, it will be appreciated that the stroke of the well form with regard to the pattern is designed to position the pattern plate either substantially flush with or just proud of the bottom surface of the flask when the molding cycle is completed. Once the stop buttons are engaged, further movement of the flask, which engages the top of the wear strips, and the pattern is precluded. In any event the pattern stool assembly comprises a well form which is spring loaded to extend beyond the pattern plate forming a well which recesses the pattern plate below the bottom edge of the flask in the flask fill position. The depth of the well can be widely varied.

Figure 11:
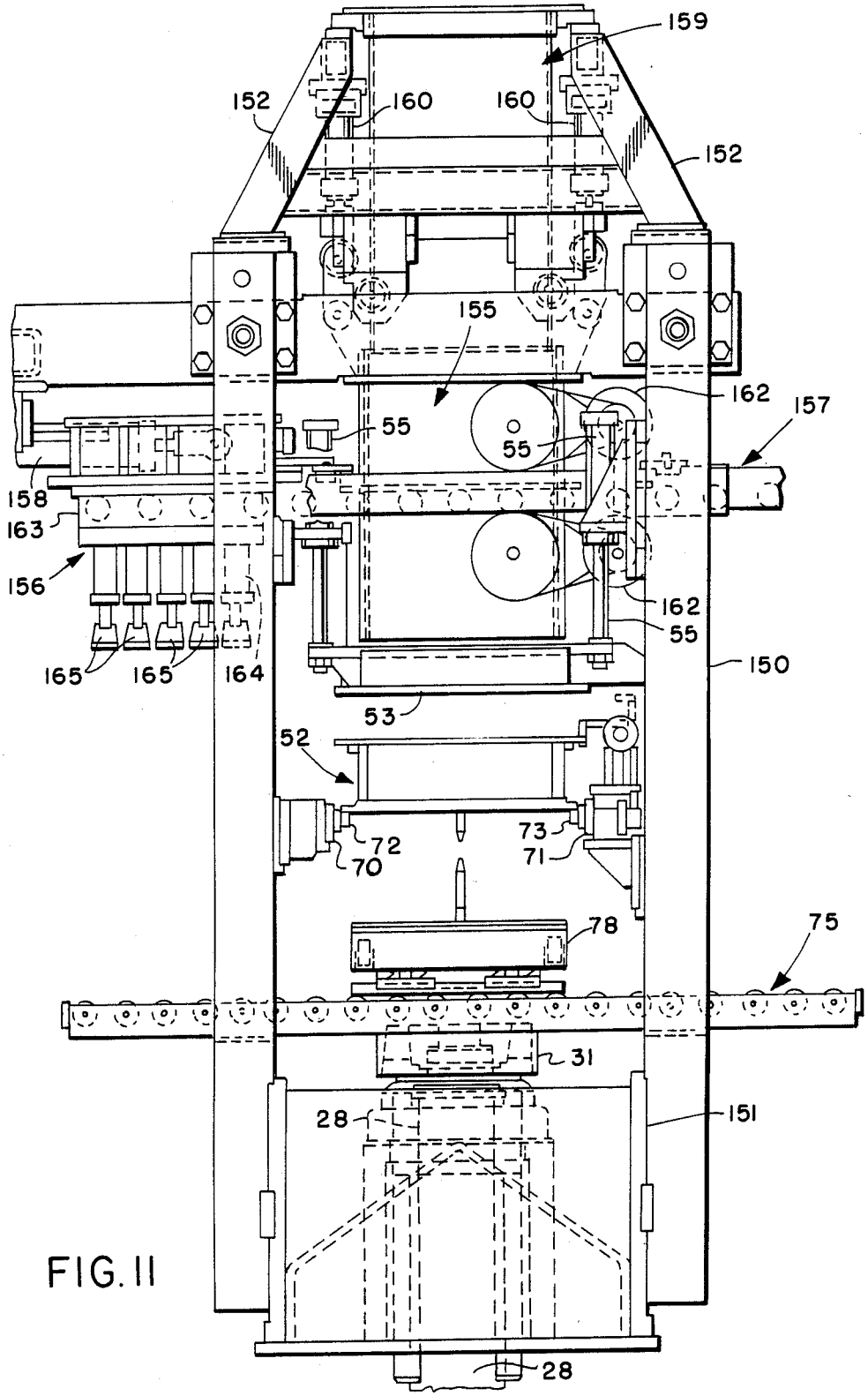
FIG. 11 is a fragmentary front elevation of another embodiment of the present invention utilizing a dump-fill and a shuttling squeeze head with equalizing feet.

Referring now to FIG. 11 there is illustrated another embodiment of the present invention which includes an upstanding frame supported on four columns 150 which extend between a base frame 151 and a head frame 152. The base frame includes the squeeze piston-cylinder assembly 28 supporting the squeeze table 31 for vertical movement to elevate pattern stool assembly 78 against the flask 52 to pick the same off the rollers 72 and 73 to elevate the flask against upset 53 which is supported on the rods 54 of four hydraulic piston-cylinder assemblies 55. In this manner the lower portion of the machine upwardly through the upset and its support is essentially the same as the machine described in connection with FIGS. 1–4.

However, instead of a blow reservoir for filling the flask, the machine utilizes a shuttling fill chute 155 and squeeze head 156. The squeeze head and fill chute are shuttled back and forth on a conveyor 157 at the direction of piston-cylinder assembly 158. In the position wherein the fill chute 155 is aligned with hopper 159, sand in such hopper may be discharged into the fill chute by opening louvered gates through the action of piston-cylinder assemblies 160. However, before doing so, the table 31 will be elevated to pick up the pattern stool assembly 78 in turn to pick up the flask in turn to engage and close against the bottom of the upset 53. At that point the piston-cylinder assemblies 160 are actuated to dump a measured amount of sand through aerators driven by motors 162. When the measured amount of sand has thus been dumped into the flask contained on the bottom by the pattern stool assembly and while engaging the upset, the piston cylinder assembly 158 is then energized to replace the sand chute 155 with the squeeze head 156.

The squeeze head 156 is essentially conventional and includes a frame member 163 to which are mounted a plurality of hydraulic piston-cylinder assemblies 164. The lower end of the piston associated with each of the cylinders carries an enlarged foot 165 against which the sand is compressed. The cylinders 162 are connected in parallel through a variable orifice valve to an air-over-oil reservoir. Such cylinders are known as equalizing cylinders and press downwardly on the sand while yet having the ability to adjust vertical height one to another so that the greatest squeeze will occur over sand areas of greatest depth.

In any event it can be seen that the two embodiments so far described are essentially the same except for the manner in which the mold is filled and the squeeze head employed.

In both embodiments, the springs of the pattern stool assembly are of a selected stiffness and preloaded by the various guide pins so that they do not compress when carrying the total weight required in the initial upward movement. Specifically, the cope or drag flask may weigh between 500 and 1,000 lbs. The well form may weigh approximately 250 lbs. and the weight of the upset frame and the pistons of the four piston-cylinder assemblies may total about 500 lbs. Nevertheless, the springs are preloaded so that the net upward force of the eight springs 108 is greater than the maximum weight of the components they will carry in such upward movement and assembly of the flask and pattern stool.

Figure 12:
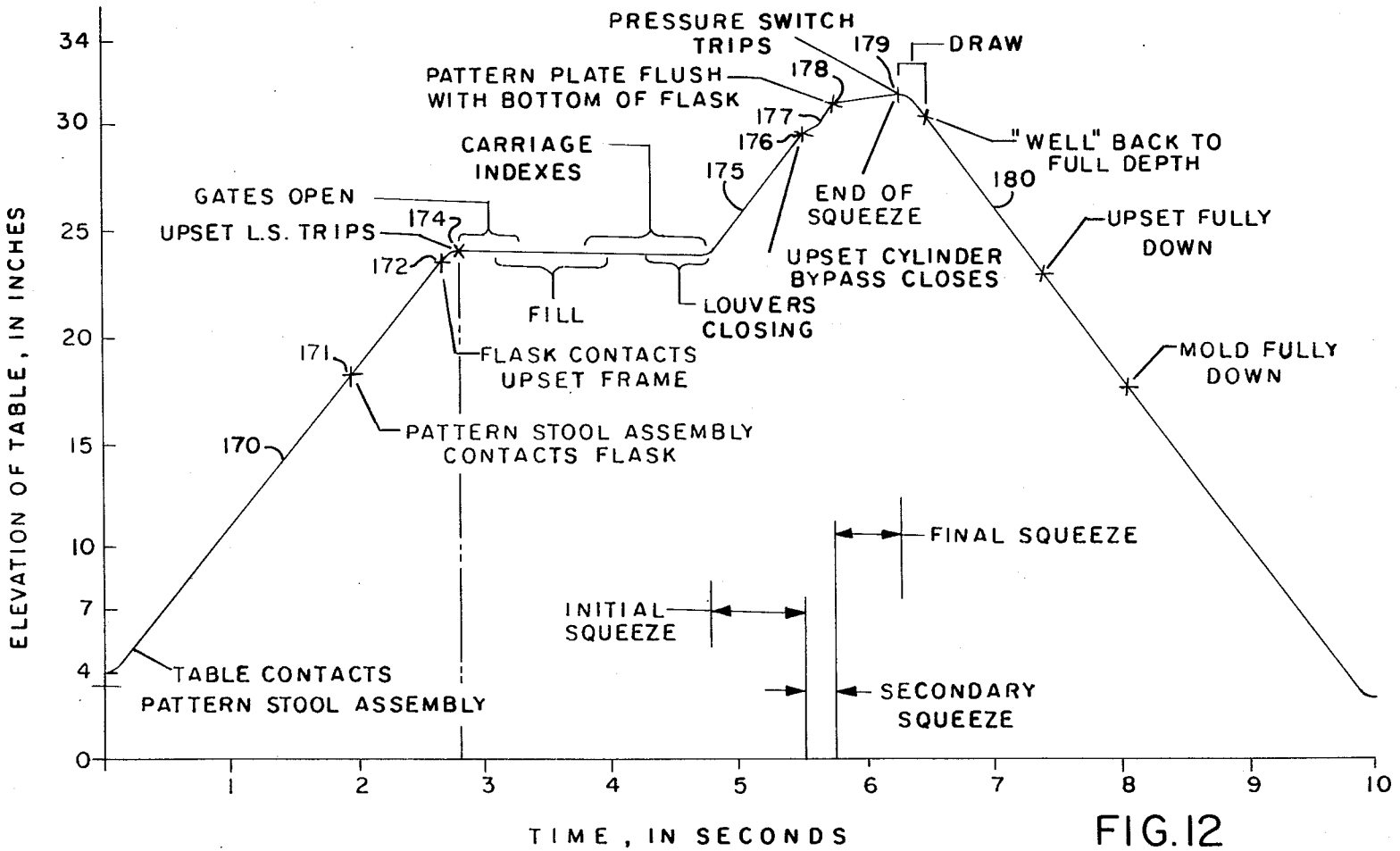
FIG. 12 is a time and motion diagram illustrating the operation of the preferred embodiment with either the blow-fill or dump-fill.

Referring now to FIG. 12 there is illustrated a time and motion diagram of the table during a complete cycle of the machine which is essentially the same whether the machine is a blow-squeeze machine as illustrated in FIGS. 1–4 or whether it is a dump-fill machine as illustrated in FIG. 11.

At the beginning of the cycle the table is down with a pattern stool assembly positioned thereover and as a flask moves into the machine the cycle commences. The table starts upwardly on the ramp 170 and initially contacts the pattern stool assembly. Continued upward movement causes the pattern stool assembly to contact the flask as indicated at 171. Further upward movement causes the flask to contact the upset frame as indicated at 172. The table continues up only slightly and the preset transducer then trips at 174 holding the table at such elevation. The table is held at such elevation for approximately slightly less than two seconds during which the blow-fill or dump-fill occurs. If the dump-fill is employed, the gates are initially opened as indicated followed by the fill with the last half of that portion of the cycle being the indexing of the carriage followed by the louvers or gates closing. The blow operation would take approximately the same portion of the cycle and is initiated as soon as the table stops with the flask and pattern stool assembly assembled together with the upset. When the filling operation is completed, the table again commences upwardly on the ramp 175. Since the upset supporting piston-cylinder assemblies are in effect vented, the well form is simply lifting the weight of the upset frame and the piston rods. During the ramp 175 the initial squeeze is performed by pushing the pattern plate, well form, flask and upset frame as a unit against the fixed head whether it be the blow head of FIGS. 1–4 or the multiple piston squeeze head of FIG. 11. This initial portion of the cycle provides a high pressure squeeze from the surface of the mold opposite the pattern plate.

At a predetermined elevation as indicated by the point 176, the upset cylinder bypass closes, in effect locking the upset frame in a given vertical position. In other words, the upset cylinders are suddenly transferred from a low pressure or essentially vented condition to a high pressure condition which effectively locks them in place. However, the table continues upwardly. Since the upset cylinders are now holding the upset frame and thus the flask and thus the well form against further vertical movement, continued upward movement of the squeeze table compresses the springs supporting the well form with respect to the pattern plate in effect telescoping or shoving the pattern plate through the well form until the stop buttons are engaged. The compression of the springs is indicated by the slight deviation in the up ramp as indicated at 177. The springs bottom out at the position indicated at 178 and the table continues upwardly to a position 179 which then trips an adjustable pressure switch.

At this point the movement of the squeeze table is then reversed, or starts down. The first thing that happens is that the springs then extend drawing the pattern from the mold. This happens at the top of the cycle and the table then continues downwardly supporting the mold on top of the extended springs. The down ramp 180 initially includes the draw moving the well back to its full depth, continues down until the upset is fully down, and continues therebeyond to position the now formed mold within the flask on the flask conveyors. The table continues down to obtain pattern stool assembly with the next flask entering the machine. It will be appreciated that the table need not go all the way down to deposit the pattern stool assembly if the machine is making only copes or drags.

In any event the squeeze cycle includes three distinct phases which are each of relatively short duration. The initial squeeze as indicated is a high pressure squeeze from the back of the pattern, the secondary squeeze is both from the face of the pattern and the back of the pattern, while the final squeeze is from the back of the pattern only.

Because of the pattern plate squeeze, molds of high uniform hardness are produced across the entire face of the pattern enabling the entire pattern face to be used for production purposes. Moreover, the cycle time is extremely short enabling a large number of molds to be produced per hour.

Referring now to FIGS. 13–16 there is illustrated yet another embodiment of the present invention. The embodiment illustrated again comprises a vertical frame shown generally at 183, the base portion 184 of which supports a vertically extending squeeze piston-cylinder assembly 185. Again the upstanding columns support flask conveyor rails 70 and 71 which support the flask 52 for movement into and out of the machine above the squeeze piston-cylinder assembly 185 and below upset frame 187.

The pattern stool assemblies 188 and 189 are mounted for movement on the shuttle conveyor 75 to be positioned between the piston-cylinder assembly 185 and the flask and upset frame. Such pattern stool assemblies each comprise a base 192 on which is supported pattern plate 193. Extending upwardly around the base is a well form 194 which includes an upward extension 195. The well form extension 195 includes an inner liner 197 and the top outer edge of the base includes a wear plate or sliding seal 199 sliding thereagainst. The lower edge of the base includes downwardly projecting feet, four in number, indicated at 201. The well form also is provided with supporting feet indicated at 202, also four in number. Mounted on the base and projecting through the well form in suitable slots are ears 204 and 205 which include top and bottom adjustable stops 206 and 207. The stops 207 engage ears 209 setting the initial position of the base or pattern plate with respect to the well while the stops 206 engage adjustable stops 210 on the well form extension 195. The stops immediately above described serve the same or similar purpose as the stops in connection with the previously described embodiments. Again, guide pins indicated at 213 may be provided to ensure that the pattern stool assembly properly engages and aligns with the flask.

Vertical movement of the base or pattern plate and the well form are obtained independently by hydraulic piston-cylinder assemblies which comprise part of the main squeeze piston-cylinder assembly 185.

For example, the main squeeze piston cylinder-assembly 185 includes a cylinder 220, a lower or main squeeze piston 221 and an upper or pattern plate squeeze piston 222 telescoped and slidingly sealed in the rod 223 of the lower piston. The lower piston is provided with a hole through the bottom of the cylinder indicated at 225 by which fluid may enter beneath the bottom piston to elevate the same. The inner or upper piston includes a transverse hole 226 through which fluid may enter flowing through the hollow column 227 to elevate the piston 222 within the bore of the rod of the lower piston.

The inner piston 222 is provided with a frame 229 which includes vertically extending feet 230 adapted to engage feet 201 on the underside of the base or pattern plate. The outer piston is provided with a frame 232 which includes vertically extending feet 233 on which lifting buttons are provided adapted to engage the buttons 202 on the well form. As indicated, guide pins 234 may be employed to ensure proper engagement. A vertically extending guide rod 235 extends from the frame 229 through the frame 232 and through the frame 236 supporting the cylinder 220. In this manner rotation of the various frames or pistons within such cylinders is precluded.

In any event the embodiment of FIG. 13 utilizes separate piston-cylinder assemblies to raise and lower both the pattern and the surrounding well form. It will be appreciated that controls may be widely varied to vary the depth of the well from one cycle to the next depending upon process parameters read from the prior molding cycle. Also, separate control of the pattern and well form seen in the embodiment of FIG. 12 may be utilized to vary the cycle so that pattern plate squeeze is obtained wholly or partially at any given point in the entire cycle.

It will of course be appreciated that above the mechanisms seen in FIG. 12, there will exist either the blow-fill form of the preferred embodiment or the dump-fill form of the embodiment of FIG. 11.

Figure 16:
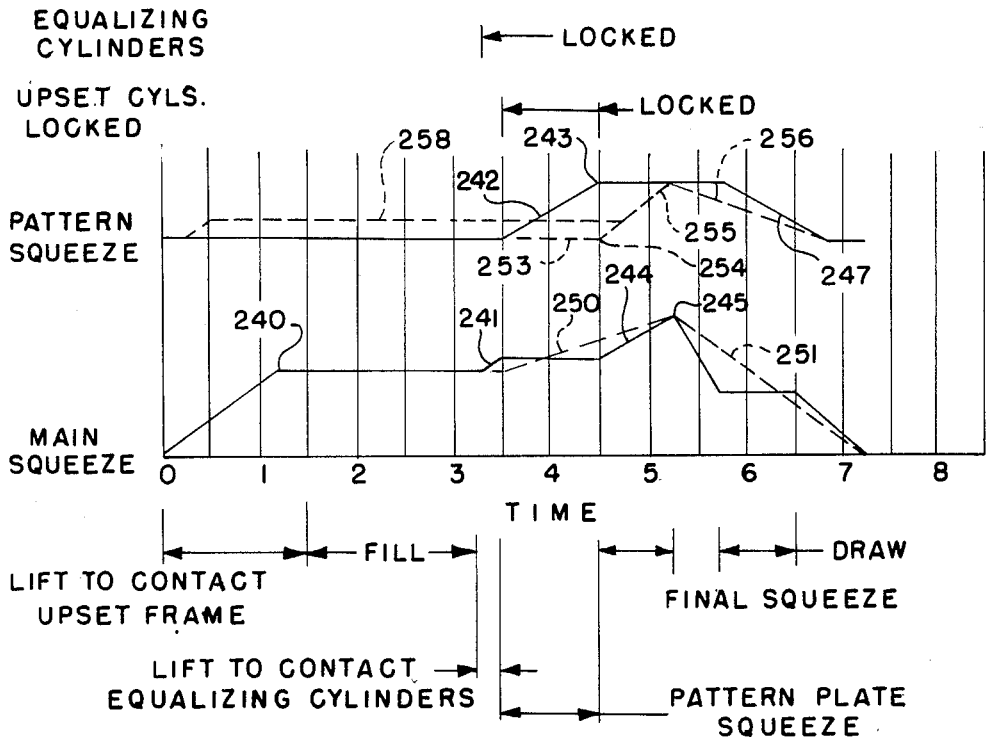
FIG. 16 is a typical time and motion diagram of the machine of FIG. 13.

Referring now to FIG. 16 there is illustrated by way of example only a few of the various typical cycles which may be employed. While one cycle illustrated pertains to the use of a dump-fill with equalizing cylinders, it will be appreciated that essentially the same cycle may be accomplished with a blow-squeeze head. Initially the main squeeze piston 221 extends which brings the well form and pattern upwardly as a unit to engage the bottom of the flask 52 and continued upward movement brings the top of the flask into engagement with the upset 187. This is indicated by the point 240 at the end of the initial ramp of the main squeeze. In the illustrated example there is no fluid entering the pattern or inner squeeze piston 222 so that its relative position to the main squeeze piston does not change. The mold chamber formed now by the upset, flask, well form and pattern is ready to fill.

At the completion of the fill operation, if a dump-fill is used together with equalizing cylinders, the main squeeze piston may be slightly elevated as indicated at 241. At this time both the equalizing cylinders and the upset cylinders may be locked in position. At this point also the pattern squeeze piston 222 may be energized moving up the ramp 242. At the point 243 the pattern bottoms out against the stops 210. At this position the final squeeze may be initiated by energizing the main squeeze piston to move up the ramp 244. At the point 245 a pressure switch is actuated. Once the maximum pressure is obtained, the main squeeze piston is lowered and then locked with the mold only a few inches from the conveyor 70–71. At this point a conventional draw stroke may occur removing the pattern from the mold. Both the main squeeze and the pattern squeeze continue then to their original positions. In this manner the mold is deposited on the conveyor and the next cycle may commence.

While the cycle just described is not precisely like the cycle of the preferred embodiment, it can be readily altered to be essentially the same. Such alteration is shown by the dotted line ramp 250 for the main squeeze during the squeeze stroke and 251 for the draw stroke. During the up ramp of the main squeeze indicated at 250 the pattern squeeze is initially held at a constant elevation indicated at 253. At point 254 a pressure switch may trip to lock the upset cylinders and cause the pattern squeeze to extend along the ramp 255, such ramp closing the well and positioning the pattern as determined by the stops 210 substantially adjacent or just proud of the bottom surface of the flask 52. At such maximum elevation of the pattern squeeze, the main squeeze continues up for a short period of time prior to the tipping of a pressure switch at point 245. At this point the pattern squeeze descends at least initially fairly rapidly to draw the pattern from the mold and then continues downwardly as indicated by the ramp 256 to its original position. In this manner the embodiment of FIG. 13 may provide essentially the same cycle as in FIG. 12.

One advantage of the embodiment of FIG. 13 is that the well depth can be set for each cycle of the machine simply by extending the pattern squeeze the desired amount as indicated by the dotted line 258. This of course can be done prior to the fill cycle and the well depth may be altered cycle-to-cycle. This then permits a sophisticated control system which may alter the well depth cycle-to-cycle depending upon certain parameters of the previously formed mold. In any event with the separate hydraulic controls for both the pattern and main squeeze, it will be seen that a number of exemplary cycles may be performed and that the well depth may be adjusted from one cycle to the next.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A foundry mold making apparatus comprising a frame, a flask, a pattern assembly, said flask and pattern assembly together defining a sand receiving cavity, a squeeze head mounted in said frame, and fluid operated lift cylinder means connected with said frame for lifting said pattern assembly and flask to squeeze sand in said cavity against said squeeze head, said pattern assembly including a well form with side walls which partially define said cavity, and a pattern plate closing the bottom of said cavity and telescopically movable within said well form between first and second positions to vary the depth of said cavity, and means for effecting relative movement between said well form and said pattern plate.

2. The apparatus of claim 1 wherein said squeeze head includes sand contacting surface means for engaging molding sand and fluid means for resisting displacement of said sand contacting surface means.

3. The apparatus of claim 1 wherein said first position of said pattern plate corresponds to a maximum depth of said cavity and including biasing means acting between said well form and said pattern plate biasing them towards said first position.

4. The apparatus of claim 3 wherein said biasing means includes springs.

5. The apparatus of claim 3 including guide means for connecting said pattern plate and said well form for straight line telescoping movement of said pattern plate within said well form parallel to the direction of movement of said lift cylinder means.

6. The apparatus of claim 3 wherein said flask rests on said well form, said lift cylinder means includes a cylinder fixed to said frame, an axially movable piston disposed in said cylinder, and means for connecting said piston to said pattern plate, and wherein movement of said well form and flask is transmitted from said pattern plate through said biasing means.

7. The apparatus of claim 6 further including locking means for locking said flask and well form against movement relative to said frame.

8. The apparatus of claim 7 wherein said locking means includes an upset frame adapted to abuttingly engage said flask and means for selectively locking said upset frame in a fixed position relative to said frame.

9. The apparatus of claim 8 wherein said means for selectively locking said upset frame includes hydraulic cylinder means acting between said frame and said upset frame, and valve means for blocking the flow of fluid from said hydraulic cylinder means.

10. The apparatus of claim 9 including means for closing said valve means when said upset frame reaches a predetermined position with respect to said frame.

11. The apparatus of claim 10 including second valve means for releasing the hydraulic pressure in said hydraulic cylinder means when the force exerted by said hydraulic cylinder means reaches a first predetermined level.

12. The apparatus of claim 11 including adjustable valve means for releasing the pressure in said lift cylinder means when the force exerted by said lift cylinder means reaches a second predetermined level.

13. The apparatus of claim 12 wherein said first predetermined force level is less than said second predetermined force level.

14. A foundry molding assembly including a pattern plate, a well form surrounding said pattern plate, said pattern plate and well form being relatively telescopically movable between two positions, and resilient biasing means urging said pattern plate and well form toward one of said positions.

15. The assembly of claim 14 including sand seal means co-acting between said well form and said pattern plate.

16. The assembly of claim 14 including guide means for guiding said pattern plate and well form in straight line movement.

17. The assembly of claim 16 wherein said guide means includes a pin fixed with respect to one of said well form and pattern plate and slidably received in a passage in the other of said pattern plate and well form.

18. The assembly of claim 17 wherein said biasing means includes a coil spring and said pin extends through said coil spring.

19. The assembly of claim 18 including a base plate, said pattern plate resting on said base plate, said springs acting between said base plate and said well form.

20. A foundry molding machine comprising a flask assembly, a squeeze head and pattern plate closing opposite ends of said flask assembly to retain sand therein, piston and cylinder means for squeezing sand in said flask assembly by moving said pattern plate within said flask assembly and with respect to said squeeze head and for thereafter squeezing sand in said flask assembly by moving said flask assembly and pattern plate together with respect to said squeeze head.

21. The machine as set forth in claim 20 wherein said flask assembly includes a well form and a flask, said pattern plate being slidable within said well form, said piston and cylinder means including means for moving said pattern plate from an initial position to a predetermined position to effect the squeezing of sand in said flask assembly.

22. The machine as set forth in claim 20 wherein said flask assembly includes a flask and a well form movable to a position abutting said flask and in which the walls of said well form form extensions of the walls of said flask, and said piston and cylinder means for squeezing sand in said flask assembly by moving said pattern plate with respect to said flask assembly and squeeze head includes means for moving said pattern plate to a predetermined position adjacent the junction between said flask and pattern frame from an initial position spaced from said junction.

23. A machine as set forth in claim 20 wherein said flask assembly includes a pattern frame and a flask, said pattern plate being slidable within said pattern frame, said piston and cylinder means including means for moving said pattern plate from an initial position to a predetermined position to effect the squeezing of sand in said flask assembly.

24. A machine as set forth in claim 20 wherein said flask assembly includes a flask and a pattern frame movable to a position abutting said flask and in which the walls of said pattern frame form extensions of the walls of said flask, and said piston and cylinder means for first squeezing sand in said flask assembly by moving said pattern plate with respect to said flask assembly and squeeze head includes means for moving said pattern plate to a predetermined position adjacent the junction between said flask and pattern frame from an initial position spaced from said junction.

25. A foundry molding machine comprising a flask assembly, a vertically movable pattern plate adapted to telescope within the bottom of said flask assembly, means to fill said flask assembly with sand, means to position a squeeze head above said flask assembly to confine the sand therein, and piston and cylinder means operative to elevate the pattern plate within said flask assembly to a predetermined position to provide a high pressure squeeze from the pattern plate and then further elevate the pattern plate and flask assembly as a unit to provide a high pressure final squeeze from the squeeze head.

26. The machine as set forth in claim 25 wherein said means to fill said flask assembly with sand and said means to position a squeeze head include a reciprocable carriage to which both of said means are connected and drive means alternately to align said means to fill said flask assembly with sand and said squeeze head with said flask assembly.

27. A machine as set forth in claim 25 wherein said piston and cylinder means includes a first cylinder, a first piston slidable in said first cylinder, an axial bore in said first piston, and a second piston slidable in said axial bore, means for connecting said second piston with said pattern plate and means for connecting said first piston with said flask assembly.

28. A machine as set forth in claim 27 wherein said flask assembly includes a flask and a pattern frame.

29. A machine as set forth in claim 27 including valve means for locking said second piston in a fixed position with respect to said first piston.

30. A machine as set forth in claim 29 including means for operating said valve means to lock said second piston when said pattern plate is in said predetermined position.

31. A machine as set forth in claim 30 including second valve means for controlling the flow of fluid into said cylinder and pressure switch means for operating said second valve means when the pressure in said cylinder reaches a predetermined pressure.

32. A foundry molding machine for forming a complete mold comprising a vertical frame, conveyor means to position a flask in said frame, fixture means operative to close the bottom of said flask, said fixture means comprising a frame adapted to contact the bottom of said flask and substantially form a downward continuation thereof, and a pattern plate mounted for telescoping movement within said frame of said fixture means from a lower position to an upper position substantially adjacent the bottom of the flask, a vertically movable upset adapted to contact the top of said flask when the fixture means is elevated to pick up the flask, means to fill the assembled upset, flask and fixture means with molding sand, a squeeze head positioned above the molding sand, means to elevate the fixture means flask and upset as a unit to compact the molding sand from the side opposite the pattern plate, means then to lock the upset while continuing to elevate the pattern plate to telescope it within and through said frame of said fixture means to such position substantially adjacent the bottom of the flask thus compacting the sand from both the side opposite the pattern plate and the pattern plate and finally continuing to elevate the flask and pattern plate as a unit to compact the sand from the side opposite the pattern plate until a predetermined pressure is reached, and then lowering the flask while drawing the pattern plate from the completed mold to place the completed mold on said conveyor means.

33. A machine as set forth in claim 32 wherein said means to fill and said squeeze head comprises a blow-squeeze head around which said upset is positioned.

34. A machine as set forth in claim 33 wherein said blow-squeeze head comprises the lower end of a blow reservoir.

35. A machine as set forth in claim 34 wherein said blow reservoir is pressurized at from about 10 to about 30 psi to fluidize and force molding sand into the assembled upset, flask and fixture means.

36. A machine as set forth in claim 35 wherein said blow-squeeze head includes a vertical wall around which said upset moves without sliding seals.

37. A machine as set forth in claim 36 wherein the exterior of said wall and the interior of said upset are of substantially the same dimension as the interior of said flask.

38. A machine as set forth in claim 32 including spring means adapted to bias said frame of said fixture means upwardly from said pattern plate.

39. A machine as set forth in claim 38 including piston-cylinder means supporting said upset and adapted to be locked at a given elevation whereby continued upward movement of said fixture means compresses said spring means telescoping said pattern plate with said frame of said fixture means.

40. A machine as set forth in claim 39 including adjustable stop means limiting such telescoping movement to position the pattern plate flush with or just proud of the bottom of the flask.

41. A method of making foundry molds including forming a sand receiving cavity by superimposing a flask on a well form and closing the bottom of the well form with a pattern plate which is telescopically received in the well form, lifting the pattern plate, flask and well form against a squeeze surface to compress initially the sand in the cavity from the squeeze surface, holding the flask and well form against movement relative to the squeeze surface while continuing to lift the pattern plate within the well form to effect a squeeze from the pattern plate, and thereafter lifting the well form and flask together with the pattern plate.

42. The method of claim 41 including lifting the pattern plate, well form, and flask until they reach a predetermined position with respect to the squeeze surface and thereafter continuing to lift the pattern plate.

43. The method of claim 42 including resiliently biasing the pattern plate to a position within the well form corresponding to maximum volume of the cavity.

44. The method of claim 43 including the step of lowering the pattern plate rapidly subsequent to the final lifting of the well form and flask together with the pattern plate.

45. The method of claim 44 including holding the well form and flask in their uppermost position while performing said step of rapidly lowering the pattern plate.

46. A method of making foundry molds comprising the steps of positioning a pattern plate in a flask assembly to close one end thereof and to define a well for receiving molding sand, charging the well so formed with sand, positioning a squeeze head to close the other end of the flask assembly, moving the pattern plate within the flask assembly while holding the squeeze head and flask assembly stationary until the pattern plate reaches a predetermined position within the flask assembly thereby to squeeze the sand from a first direction, and moving the pattern plate and flask assembly as a unit with respect to the squeeze head thereby to squeeze the sand from a second direction.

47. A method as set forth in claim 46 wherein said step of moving the pattern plate and flask assembly as a unit is performed after said step of moving the pattern plate to a predetermined position in the flask assembly.

48. A method as set forth in claim 46 further including the step of controlling the initial position of the pattern plate in the flask assembly to control the amount of squeezing of sand from the first direction.

49. A method as set forth in claim 46 wherein said step of positioning the pattern plate in the flask assembly includes the steps of positioning a well form in abutting engagement with a flask and said step of moving the pattern plate to a predetermined position in the flask assembly includes the step of moving the pattern plate to a position determined with respect to the junction between the flask and well form.

50. A method as set forth in claim 46 wherein said step of positioning the pattern plate in the flask assembly includes the steps of positioning a pattern frame in abutting engagement with a flask and said step of moving the pattern plate to a predetermined position in the flask assembly includes the step of moving the flask to a position determined with respect to the junction between the flask and pattern frame.

51. A method as set forth in claim 46 wherein said step of moving the pattern plate to a predetermined position includes the step of moving a first piston and said step of moving the pattern plate and flask assembly as a unit includes the step of moving a second piston and the first piston together.

52. A method as set forth in claim 51 wherein said step of moving the first and second pistons together includes the step of locking the first piston in a fixed piston relative to the second piston and extending the second piston.

* * * * *